US007455634B2

(12) United States Patent
Barniak

(10) Patent No.: US 7,455,634 B2
(45) Date of Patent: Nov. 25, 2008

(54) SPINAL CORE PLATFORM

(76) Inventor: Carl Barniak, 7488 Sharon Rd., Newburgh, IN (US) 47630

( * ) Notice: Subject to any disclaimer, the term of this patent is extended or adjusted under 35 U.S.C. 154(b) by 0 days.

(21) Appl. No.: 11/685,107

(22) Filed: Mar. 12, 2007

(65) Prior Publication Data

US 2008/0227609 A1 Sep. 18, 2008

(51) Int. Cl.
*A63B 26/00* (2006.01)
*A63B 21/068* (2006.01)

(52) U.S. Cl. ..... 482/143; 482/96

(58) Field of Classification Search ..... 482/95, 482/96, 142, 143, 24, 38–41
See application file for complete search history.

(56) References Cited

U.S. PATENT DOCUMENTS

| | | | | | |
|---|---|---|---|---|---|
| 2,262,761 | A | * | 11/1941 | Gay | 482/24 |
| 4,620,701 | A | * | 11/1986 | Mojden | 482/41 |
| D300,157 | S | * | 3/1989 | Yates | D21/690 |
| 4,838,250 | A | * | 6/1989 | Angelo | 606/237 |
| 5,201,694 | A | * | 4/1993 | Zappel | 482/133 |
| D339,835 | S | * | 9/1993 | Hsieh | D21/691 |
| 5,302,164 | A | | 4/1994 | Austin | |
| 5,403,253 | A | * | 4/1995 | Gaylord | 482/43 |
| 6,217,483 | B1 | | 4/2001 | Kallassy | |
| 6,302,828 | B1 | * | 10/2001 | Martin et al. | 482/69 |
| 6,712,744 | B2 | | 3/2004 | Buechel, Jr. et al. | |
| D544,050 | S | * | 6/2007 | Webber | D21/686 |

* cited by examiner

*Primary Examiner*—Fenn C. Mathew
*Assistant Examiner*—Allana Lewin
(74) *Attorney, Agent, or Firm*—QuickPatents, Inc.; Kevin Prince

(57) ABSTRACT

A freestanding exercise device for a person is disclosed. A stand adjustably supports a generally U-shaped support frame that includes a back rest and a pair of support arms that each terminate in an adjustable hand grip member from which a plurality of ring assemblies are suspended. A pair of footrests are adjustably fixed to base. A high-station assembly includes a high station support member fixed to the stand. A lateral support and a traction bar support arm are fixed to the high station support member, and a traction bar is fixed to the traction bar support arm. The lateral support is fixed at either end thereof to a ring support arm from each of which one ring assembly is suspended. In use, the person may adjust the height of the support frame and the back rest support, and then position himself within the exercise device by resting his back against the back rest, resting his arms on the support arms, gripping the hand grip members, and then performing leg lift exercises. Each support arm is preferably adjustably fixed with a support arm adjustment means, such that the person may additionally adjust the distance between the support arms. The person may use the lower suspended ring assemblies to perform push-up type exercises, or, alternately, he may grasp each ring of the high-station assembly to perform pull-up and related exercises. The person may grasp the traction bar and hang therefrom to create traction forces within the person's back.

4 Claims, 6 Drawing Sheets

SPINAL CORE PLATFORM

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to exercise, and more particularly to an improved spinal decompression and core conditioning exercise and therapy device.

DISCUSSION OF RELATED ART

Exercise devices of the type resembling leg-lift chairs are known in the prior art. For example, U.S. Pat. No. 5,302,164 to Austin on Apr. 12, 1994, teaches such a device for mounting into the corner of a room. Some aspects of this type of device are adjustable, but not the distance between the arm supports. Thus, people with body dimensions that do not conform well to such a device may find using such a device uncomfortable. Similarly, U.S. Pat. No. 6,712,744 to Buechel, Jr. et al., on Mar. 30, 2004, teaches an exercise device having push-up bars. The distance between the bars is not adjustable in this device, although the height of the bars are. The device disclosed in U.S. Pat. No. 6,485,398 to Kreft on Nov. 26, 2002 has similar drawbacks.

Certain exercises are well-suited for use in spinal decompression and core conditioning exercise and therapy. For example, hip flexion and both high and low ring suspension type exercises are often used in such physical therapy. However, exercise devices in the prior art that accommodate such exercises typically have significant drawbacks. Principally, such exercise devices do not focus on exercises used for spinal decompression and core conditioning, and thus multiple exercise devices are necessary in physical therapy offices that are often already too crowded. Further, to the extent that such prior art devices accommodate such exercise therapies, the devices are not fully adjustable. Often those who are undergoing such physical therapy have non-average body dimensions, and as such a one-size-fits-all exercise machine is not comfortably or profitably used.

Therefore, there is a need for a compact, efficient exercise machine that focuses on the exercises required for clinical rehab platform, spinal decompression and core conditioning exercise and therapy. Such a needed device would be adjustable in a relatively large number of ways so as to accommodate virtually anyone, regardless of their size, when performing hip flexion or suspended ring exercises. The present invention accomplishes these objectives.

SUMMARY OF THE INVENTION

The present device is a freestanding exercise device for a person. A stand includes a substantially horizontal base that is rigidly fixed to an upright support member, which includes a support frame attachment means. A generally U-shaped support frame is attached to a substantially vertical support post that is slidably and adjustably received by the upright support member. The support frame attachment means of the upright support member preferably includes an adjustable means for adjusting the height of the U-shaped support frame with respect to the stand. A pair of footrests are included, each adjustably fixed to base such that the person may position each of the footrests to a desirable position.

The support frame includes a back rest support and a pair of support arms. Each support arm is fixed to the back rest support and terminates in a hand grip receiver that receives a hand grip member fixedly and slidably within. The support frame further includes a back rest fixed between each support arm to the back rest support. The exercise device may further include a plurality of ring assemblies, each of which having a ring fixed to a lower end of a flexible connector. One such ring assembly may be suspended from each hand grip member.

In use, a person may adjust the height of the support frame and the back rest support, and then position himself within the exercise device by resting his back against the back rest, resting his arms on the support arms, gripping the hand grip members, and then performing leg lift exercises. Each support arm is preferably adjustably fixed with a support arm adjustment means, such that the person may additionally adjust the distance between the support arms. The person may use the suspended ring assemblies to perform push-up type exercises.

Preferably the back rest support is fixed to at least one pivot plate, each being pivotally attached to the support post. As such, the U-shaped support frame and the stand form an angle $\alpha$ that may also be adjusted by the person.

In a preferred embodiment of the invention, a high-station assembly is included for performing additional exercises. The high-station assembly includes a high station support member fixed slidably within a support member receiver that itself is rigidly fixed to the upright support member, or alternately to the vertical support post. A lateral support is fixed proximate a center portion thereof to the high station support member, as is a traction bar support arm. A traction bar is fixed to the traction bar support arm, preferably with an adjustable bar support means. As such, the person may grasp the traction bar and hang therefrom to create traction forces within the person's back.

The lateral support is fixed at either end thereof to a ring support arm. One of the ring assemblies is fixed to each ring support arm. As such, the person may grasp each ring of each ring assembly of the high-station assembly to perform pull-up and related exercises. The present device is a compact, efficient exercise apparatus that focuses on the exercises required for clinical rehab platform, spinal decompression and core conditioning exercise and therapy. The present invention is adjustable in a relatively large number of ways so as to accommodate virtually anyone, regardless of their size, when performing such exercise and therapies. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
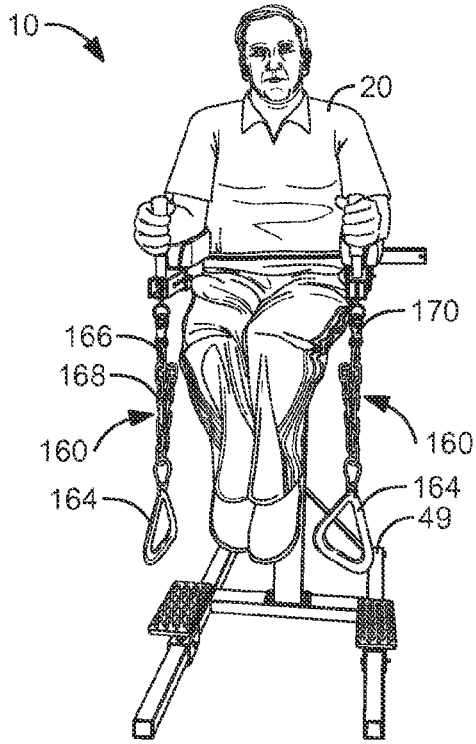
FIG. 1 is a perspective view of the invention, illustrating the invention as used by a person performing a leg left exercise.
Figure 2:
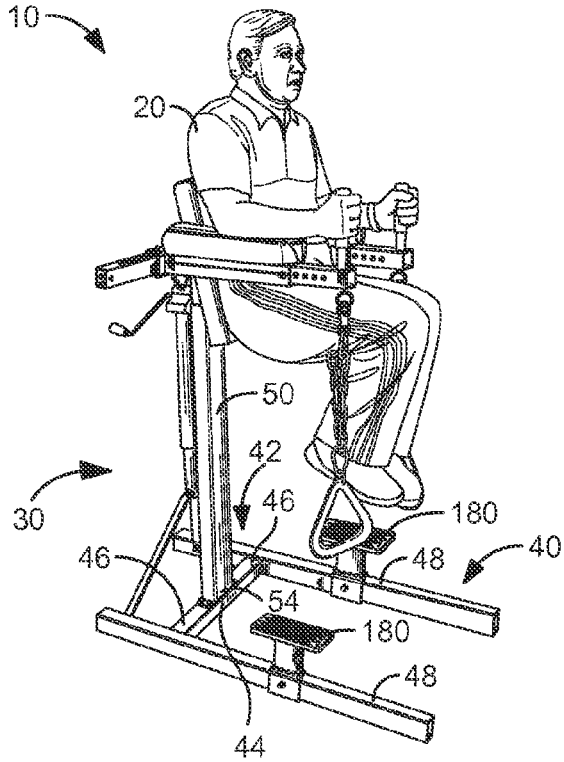
FIG. 2 is a perspective view somewhat from the right side, illustrating the invention as used by the person performing the leg left exercise.
Figure 4:
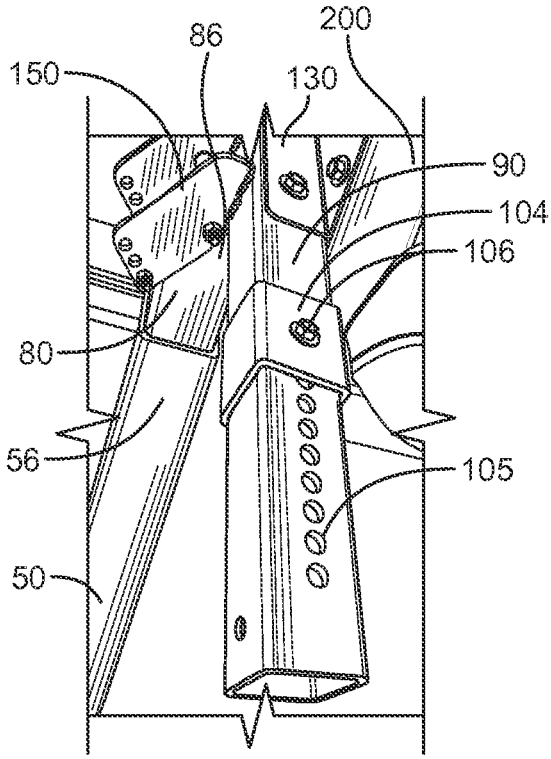
FIG. 4 is a partial view of the invention, illustrating in more detail a support frame attachment means and a support arm adjustment means.
Figure 7:
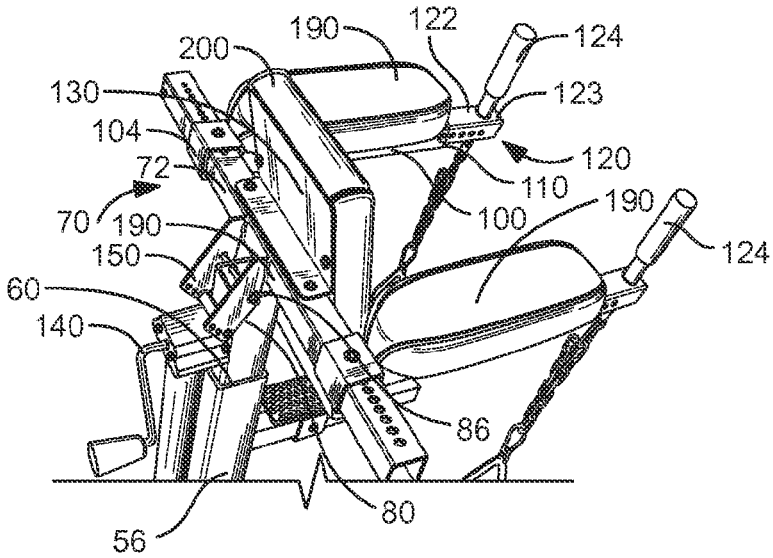
FIG. 7 is a partial view of the invention, illustrating in more detail crank mechanism for adjusting the height of a U-shaped support frame.
Figure 9:
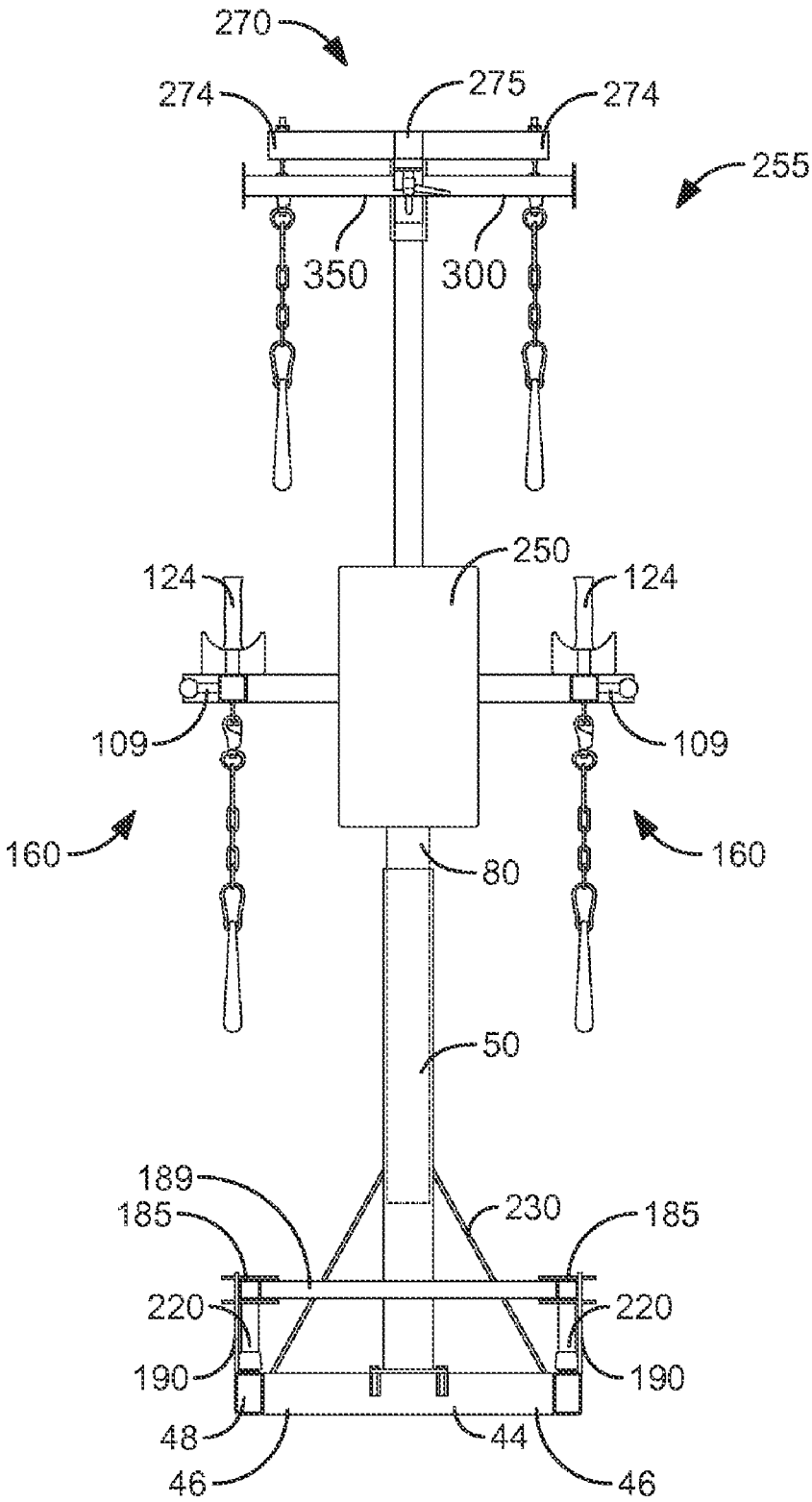
FIG. 9 is a front elevational view of the embodiment of FIG. 8.

FIGS. 1 and 2 illustrate a freestanding exercise device 10 for a person 20. A stand 30 includes a substantially horizontal base 40 that is rigidly fixed to a lower end 54 of an upright support member 50. An upper end 56 of the upright support member 50 includes a support frame attachment means 60 (FIGS. 4 and 7). The base 40 preferably includes a generally H-shaped base frame 42 having an elongated base member 44 having two ends 46, each end 46 being fixed generally perpendicularly to an elongated base leg 48 (FIGS. 2 and 9). The horizontal base 40 and upright support member 50 are preferably made for a rigid metal non-circular cross-section stock material, such as from a steel or iron substantially square cross-sectional stock material.

Figure 3:
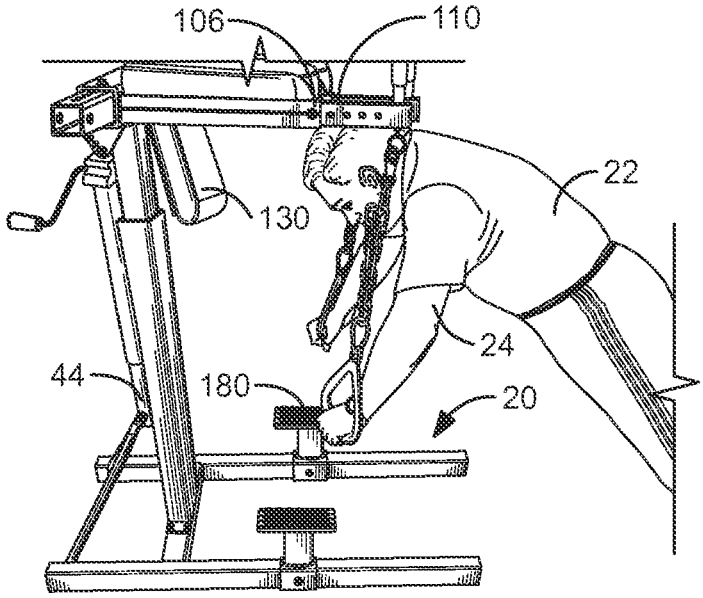
FIG. 3 is a partial perspective view of the invention somewhat from the right side, illustrating the invention as used by the person performing a an elevated push-up exercise.

In the simplest embodiments of the invention, illustrated in FIGS. 1-3, a pair of footrests 180 are included, each adjustably fixed to one of the base legs 48 such as by a sliding sleeve and bolt as shown in FIGS. 2 and 3. As such, the person 20 may position each of the footrests 180 to a desirable position.

Figure 8:
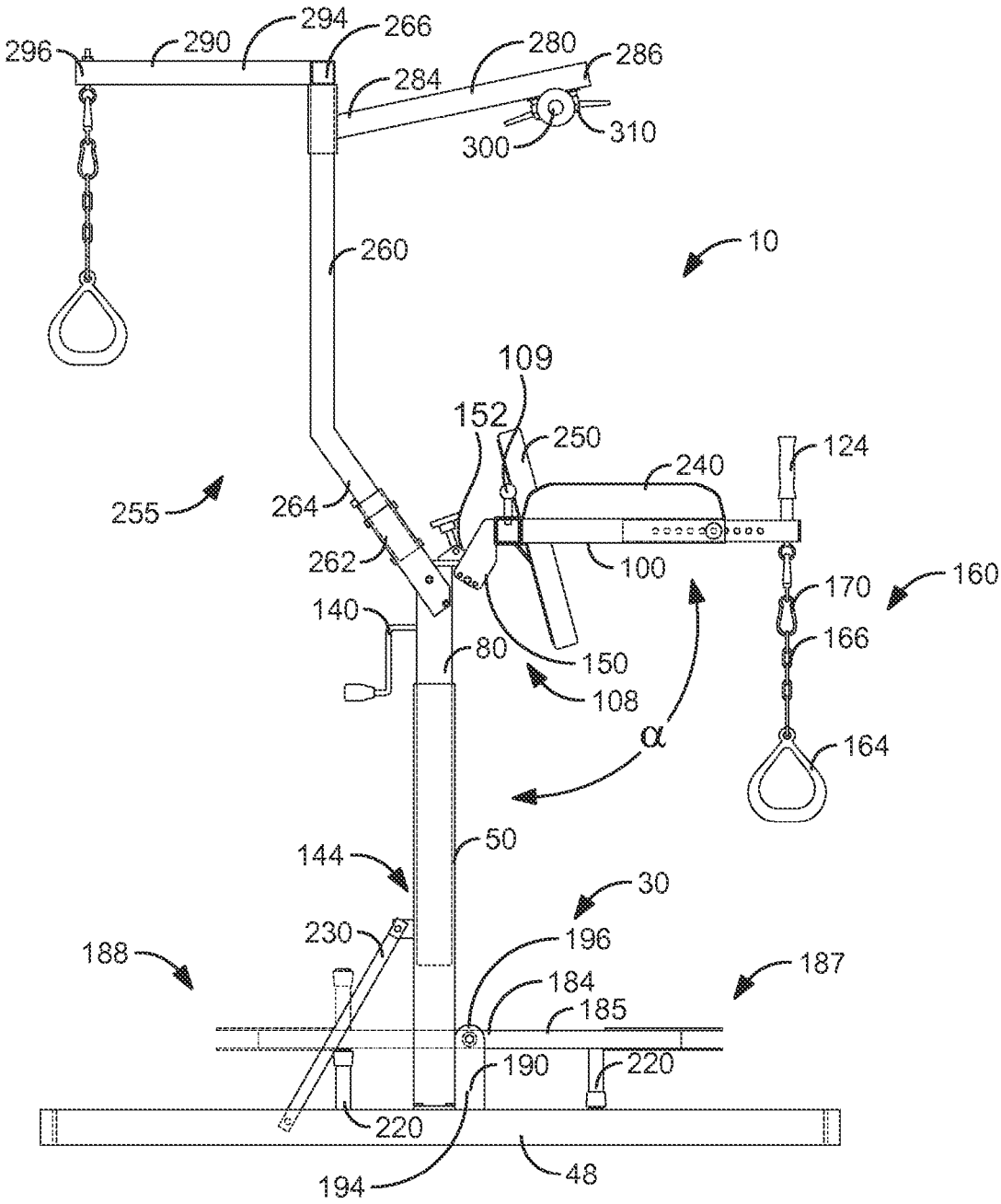
FIG. 8 is a right-side elevational view of an alternate embodiment of the invention, illustrating a high station assembly.

Alternately, in a preferred embodiment, the exercise device 10 includes a pair of elongated footrests 185 (FIGS. 8-10), each being pivotally fixed at a proximal end 184 thereof to an upper end 196 of a footrest pivot member 190. The footrest pivot member 190 is fixed at a lower end 194 thereof to one of the elongated base legs 48. Each elongated footrest 185 includes a vertical stand-off member 220 for supporting the footrest in a generally horizontal orientation when the footrest is in a forward orientation 187 (FIG. 8). Further, each base leg 48 includes one of the vertical stand-off members 220 for supporting one of the footrests 185 in a generally horizontal orientation when the footrest is in a rearward orientation 188 (FIG. 8). As such, the elongated footrests 185 may be pivoted into either the forward or rearward orientations 187,188 depending on the type of exercise the person 20 desires to perform. Each footrest is made substantially from a rigid metal stock material.

A generally U-shaped support frame 70 is attached at one side 72 thereof to a substantially vertical support post 80 that is slidably and adjustably received by the upright support member 50, such as by welding, for example. The support frame 70 includes a back rest support 90 and a pair of support arms 100. Each support arm 100 is fixed at a back end 104 thereof to the back rest support 90 and terminates at a front end 106 in a hand grip receiver 110. A hand grip member 120 is fixable and slidably received within each hand grip receiver 110. The support frame 70 further includes a back rest 130 fixed between each support arm 100 to the back rest support 90. The support frame 70, each support arm 100, and each hand grip member 120 are preferably made from a rigid metal stock material. For added comfort, each support arm 100 further includes a resilient pad 240 fixed to a top side thereof preferably with a plurality of bolts (not shown), and the back rest 130 includes a resilient pad 250 fixed to a front side thereof, also preferably with a plurality of bolts (FIG. 4).

In use, a person may adjust the height of the support frame 70 and the back rest support 90, and then position himself within the exercise device 10 by resting his back 22 against the resilient pad 250 of the back rest 130, resting his arms 24 on the resilient pads 240 of the support arms 100, gripping the hand grip members 120, and then performing leg lift exercises.

Each support arm 100 is preferably adjustably fixed at the back end 104 of the support frame 70 with a support arm adjustment means 108 (FIG. 4), such that the person 20 may additionally adjust the distance between the support arms 100. Such a support adjustment means 108 may be a series of apertures 108 in the back rest support arm 90, the back rest support arm 90 being made from a non-circular cross-section metallic bar stock, or the like, as shown in FIG. 4, and the back end 104 of each support arm 100 being a cooperating metallic sleeve that slidably receives the back rest support arm 90. As such, the back end 104 of each support arm may include a bolt 105 that cooperates with each aperture 108 to fix the position of the support arm 100 on the back rest support arm 90. Alternately, the support adjustment means 108 may be a cam-lock type of device (not shown) for locking the relative positions of the back rest support arm 90 and each support arm 100, or other equivalent means known in the art.

Figure 5:
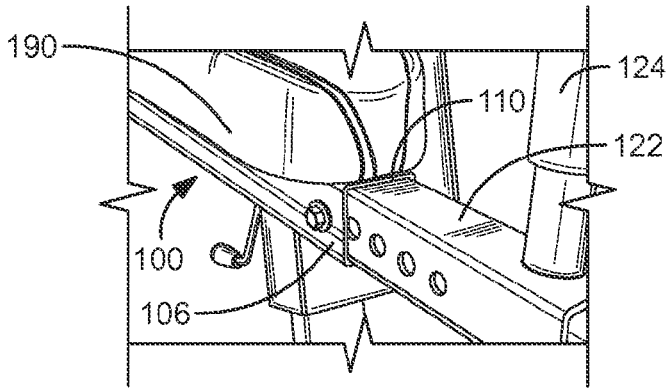
FIG. 5 is a partial view of the invention, illustrating in more detail a hand grip member adjustably fixed within a handgrip receiver.

In a similar manner, each hand grip member 120 is preferably adjustably and slidably fixed within each handgrip receiver 110 (FIG. 5), allowing the person 20 to additionally adjust the distance between each hand grip member 120 and the back rest 130. Each hand grip member 120 preferably further includes a substantially horizontal grip arm 122 that is slidably and adjustably fixed within the handgrip receiver 110, and further includes a substantially vertical hand grip 124 fixed to a front end 123 of each grip arm 100 (FIG. 7). The hand grip 124 may include a soft or resilient pad for added comfort.

Figure 6:
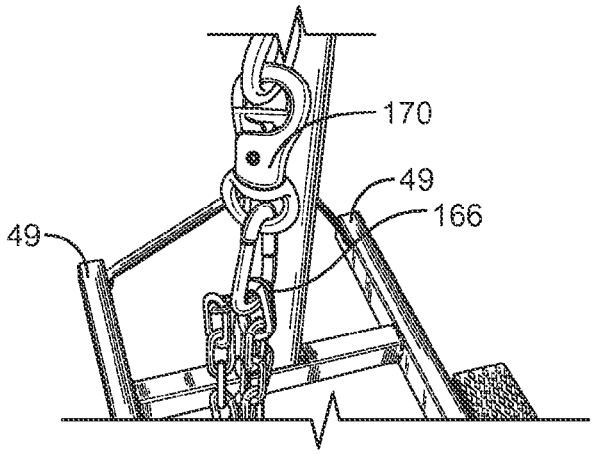
FIG. 6 is a partial view of the invention, illustrating in more detail a ring assembly fixed at an upper end thereof to the hand grip member.

The exercise device 10 may further include a plurality of ring assemblies 160, each of which have a ring 164 fixed to a lower end of a flexible connector 166, such as a strong chain or cable (FIG. 1). In one embodiment, an upper end 168 of each flexible connector 166 is fixed to the hand grip member 120, preferably with an adjustable attachment means 170 such as a quick-disconnect clip, or the like, as shown in FIG. 6.

Additionally, the support frame attachment means 60 of the upright support member 50 preferably includes an adjustable means 140 for adjusting the height of the U-shaped support frame 70 with respect to the stand 30. Such an adjustable means 140 is preferably a manual crank mechanism 140, a hydraulic lift cylinder system (not shown), or other lifting means as are known in the art. In such an embodiment, a lower end 144 of the manually-adjustable crank mechanism 140 is fixed to each base leg 48 with an angle bracket 230 (FIGS. 8 and 9).

Preferably the back rest support 90 is fixed to at least one pivot plate 150 (FIG. 4), each pivot plate 150 being pivotally attached to a top end 86 of the support post 80. As such, the U-shaped support frame 70 and the stand 30 form an angle $\alpha$ that may be adjusted by the person 20 (FIG. 8). A bolt 152 may be used to fix the angle α, such bolt 152 being either a conventional threaded bolt tightened with a conventional nut as shown in FIG. 8, or a manually actuated spring bolt 109, as shown in FIG. 8, which does not require any tools to remove or attach.

Figure 10:
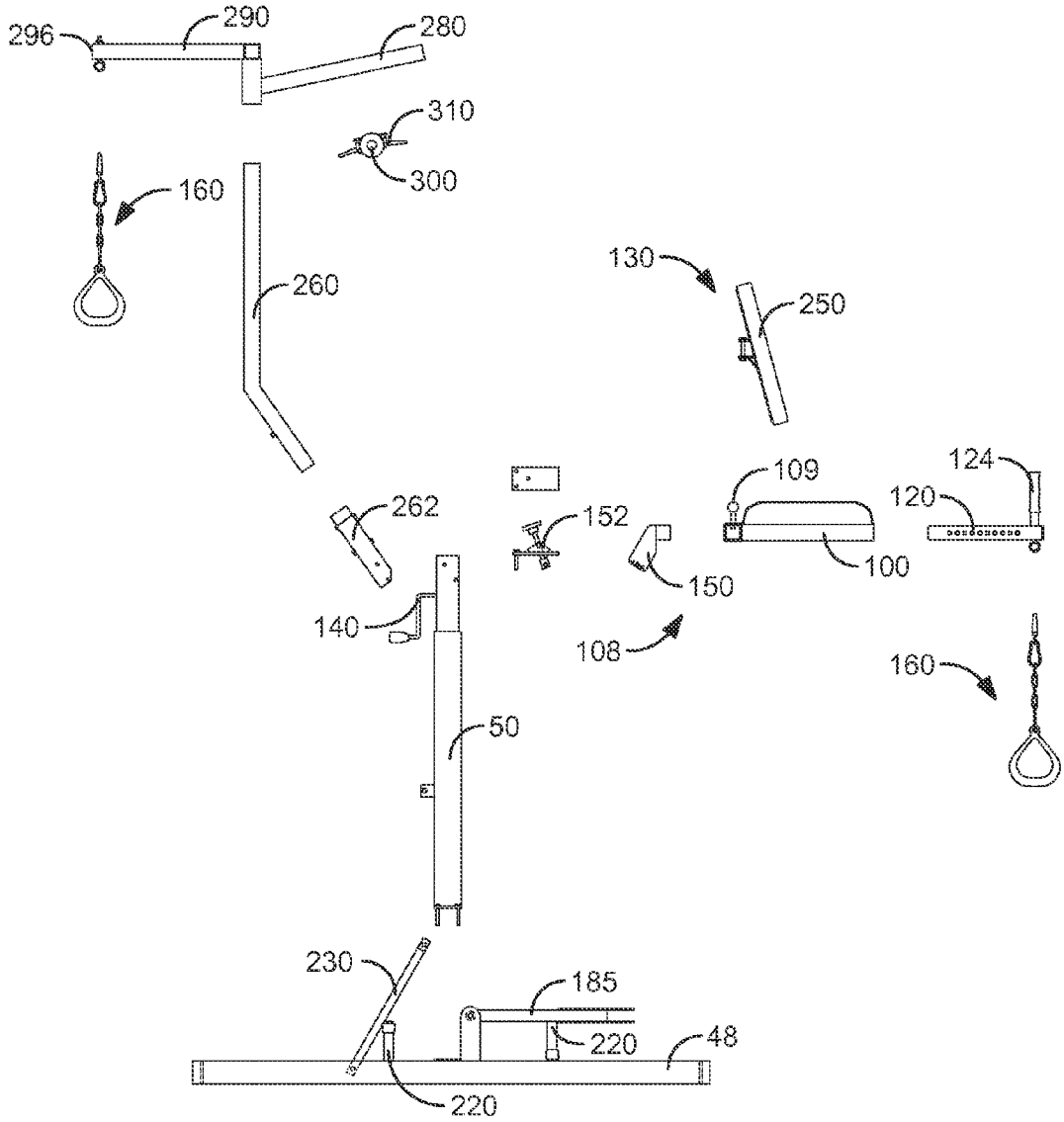
FIG. 10 is an exploded right-side elevational view of the embodiment of FIG. 8.

In a preferred embodiment of the invention, illustrated in FIGS. 8-10, a high-station assembly 255 is included for performing additional exercises. The high-station assembly 255 includes a high station support member 260 fixed at a lower end 264 thereof slidably within a support member receiver 262 that itself is rigidly fixed to the upper end 56 of upright support member 50 or alternately to the vertical support post 80. A lateral support 270 is fixed proximate a center portion 275 thereof to an upper end 266 of the high station support member 260, as is a proximal end 284 of a traction bar support arm 280. A traction bar 300 is fixed proximate the center 350 thereof to a distal end 286 of the traction bar support arm 280 (FIG. 9), preferably with an adjustable bar support means 310. As such, the person 20 may grasp the traction bar 300 and hang therefrom to create traction forces within the person's back 22.

The lateral support is fixed at either end 274 thereof to a proximal end 294 of a ring support arm 290. One of the ring assemblies 160 is fixed at its upper end 168 to a distal end 296 of each ring support arm 290. As such, the person 20 may grasp each ring 264 of each ring assembly 160 of the high-station assembly 255 to perform pull-up and related exercises.

The high station support member 260, the support member receiver 262, the lateral support 270, the traction bar support arm 280, the traction bar 300, and each ring support arm 290 are made from a rigid metal stock material, such as substantially square metal bar stock. Such stock material may be easily welded or bolted to fix one component to another in a rigid, yet strong and durable manner, capable of supporting the full weight of the person 20.

While a particular form of the invention has been illustrated and described, it will be apparent that various modifications can be made without departing from the spirit and scope of the invention. For example, the attachment and adjustment means 60, 80, and 310 may be any of a variety of such means as are known in the art. Further, the crank mechanism 140 may be replaced by any suitable adjustment means known in the art. Accordingly, it is not intended that the invention be limited, except as by the appended claims.

What is claimed is:

1. A freestanding exercise device for a person, comprising:

a stand that includes a substantially horizontal base rigidly fixed to a lower end of an upright support member that includes a support frame attachment means at an upper end thereof;

a generally U-shaped support frame attached at one side to a substantially vertical support post slidably and adjustably received by the upright support member, the support frame including a back rest support and a pair of support arms, each support arm fixed at a back end thereof to the back rest support and terminating at a front end in a hand grip receiver, a hand grip member fixed to the hand grip receiver, the support frame further including a back rest fixed between each support arm to the back rest support;

the base further including a generally H-shaped base frame having an elongated base member having two ends, each end fixed generally perpendicularly to an elongated base leg, a pair of elongated footrests each pivotally fixed at a proximal end thereof to an upper end of a footrest pivot member that is itself fixed at a lower end thereof to one of the elongated base legs, each footrest including a vertical stand-off member for supporting the footrest in a generally horizontal orientation when the footrest is in a forward orientation, each base leg including one of the vertical stand-off members for supporting one of the footrests in a generally horizontal orientation when the footrest is in a rearward orientation;

whereby the person may adjust the height of the support frame and the back rest support, and then positioning himself within the exercise device by resting his back against the back rest, resting his arms on the support arms, and gripping the hand grip member while performing leg lift exercises.

2. A freestanding exercise device for a person, comprising:

a stand that includes a substantially horizontal base rigidly fixed to a lower end of an upright support member that includes a support frame attachment means at an upper end thereof;

a generally U-shaped support frame attached at one side to a substantially vertical support post slidably and adjustably received by the upright support member, the support frame including a back rest support and a pair of support arms, each support arm fixed at a back end thereof to the back rest support and terminating at a front end in a hand grip receiver, a hand grip member fixed to the hand grip receiver, the support frame further including a back rest fixed between each support arm to the back rest support, the support frame attachment means of the upright support member including a manually adjustable crank mechanism for adjusting the height of the U-shaped support frame with respect to the stand, a lower end of the manually adjustable crank mechanism fixed to back ends of each base leg with an angle bracket;

the base further including a generally H-shaped base frame having an elongated base member having two ends, each end fixed generally perpendicularly to an elongated base leg;

whereby the person may adjust the height of the support frame and the back rest support, and then positioning himself within the exercise device by resting his back against the back rest, resting his arms on the support arms, and gripping the hand grip member while performing leg lift exercises.

3. A freestanding exercise device for a person, comprising:

a stand that includes a substantially horizontal base rigidly fixed to a lower end of an upright support member that includes a support frame attachment means at an upper end thereof;

a generally U-shaped support frame attached at one side to a substantially vertical support post slidably and adjustably received by the upright support member, the support frame including a back rest support and a pair of support arms, each support arm fixed at a back end thereof to the back rest support and terminating at a front end in a hand grip receiver, a hand grip member fixed to the hand grip receiver, the support frame further including a back rest fixed between each support arm to the back rest support;

a substantially vertical high station support member fixed at a lower end thereof proximate to the upper end of the upright support member, the high station support having an upper end thereof fixed proximate to a center portion of a lateral support and to a proximal end of a traction bar support arm, the lateral support fixed at each end thereof to a proximal end of a ring support arm, a traction bar fixed proximate the center thereof to a distal end of the traction bar support arm;

whereby the person may adjust the height of the support frame and the back rest support, and then positioning himself within the exercise device by resting his back against the back rest, resting his arms on the support arms, and gripping the hand grip member while performing leg lift exercises.

4. The exercise device of claim 3 wherein the traction bar is adjustably fixed to the traction bar support arm by an adjustable bar support means.

* * * * *